US009016669B2

(12) United States Patent
Johnson et al.

(10) Patent No.: US 9,016,669 B2
(45) Date of Patent: Apr. 28, 2015

(54) CONVERTIBLE BARRICADE AND METHOD FOR ITS USE

(71) Applicants: David Johnson, Brooksville, FL (US); Phillip Zee, Weeki Wachee, FL (US)

(72) Inventors: David Johnson, Brooksville, FL (US); Phillip Zee, Weeki Wachee, FL (US)

( * ) Notice: Subject to any disclaimer, the term of this patent is extended or adjusted under 35 U.S.C. 154(b) by 0 days.

(21) Appl. No.: 13/767,866

(22) Filed: Feb. 14, 2013

(65) Prior Publication Data

US 2013/0207061 A1 Aug. 15, 2013

Related U.S. Application Data

(60) Provisional application No. 61/598,718, filed on Feb. 14, 2012.

(51) Int. Cl.
*E04H 17/16* (2006.01)
*E01F 13/02* (2006.01)

(52) U.S. Cl.
CPC ..... *E04H 17/16* (2013.01); *E01F 13/022* (2013.01)

(58) Field of Classification Search
USPC ..... 403/83, 84, 92, 102, 103, 104; 40/610, 40/605.15; 404/6, 9; 256/1, 24–27; 116/63 P, 63 T
See application file for complete search history.

(56) References Cited

U.S. PATENT DOCUMENTS

| | | | | | |
|---|---|---|---|---|---|
| 3,811,151 | A * | 5/1974 | Kuemmerlin | 16/329 |
| 4,298,186 | A * | 11/1981 | Glass | 256/64 |
| 4,999,937 | A * | 3/1991 | Bechtold | 40/610 |
| 5,046,885 | A * | 9/1991 | Thurston | 404/10 |
| 5,356,119 | A * | 10/1994 | Schock | 256/26 |
| 5,458,434 | A * | 10/1995 | Bent et al. | 404/6 |
| 5,621,992 | A * | 4/1997 | Mandell et al. | 40/610 |
| 5,878,802 | A * | 3/1999 | Richter et al. | 160/135 |
| 5,964,053 | A * | 10/1999 | Liu | 40/610 |
| 6,101,967 | A * | 8/2000 | Glass et al. | 116/63 P |
| 6,257,559 | B1 * | 7/2001 | Mouri | 256/26 |
| 7,172,176 | B1 * | 2/2007 | Eastland | 256/26 |
| 2003/0099511 | A1 * | 5/2003 | Lund | 404/6 |
| 2011/0227015 | A1 * | 9/2011 | Perryman | 256/19 |

* cited by examiner

*Primary Examiner* — Michael P Ferguson
*Assistant Examiner* — Daniel Wiley
(74) *Attorney, Agent, or Firm* — Muskin & Farmer LLC

(57) ABSTRACT

A collapsible A-frame sign that can be converted into a panel that is capable of interlocking with other panels to form a physical barricade. When used alone, the device works as an A-frame sign or barrier by folding two frames hinged around a common end at the top of frames to form an A-shape allowing it to be erected in an upright position. Additionally, the device can be locked into a 180-degree angle, and joined with other identical devices to form a barricade at a height twice of the length of single frame. As a result, a group of locked devices can be used as a barricade as well as a warning signs.

8 Claims, 12 Drawing Sheets

DETAIL A
SCALE 1 : 4

CONVERTIBLE BARRICADE AND METHOD FOR ITS USE

CROSS REFERENCE TO RELATED APPLICATIONS

This application claims benefit to provisional patent application no. 61/598,718 filed Feb. 14, 2012, which is incorporated by reference herein in its entirety.

FIELD OF THE INVENTION

The present device relates to portable physical barriers designed to prevent pedestrian traffic from entering a particular area by serving as both a warning sign and a physical barrier.

BACKGROUND

Physical barriers in the form of A-frame signs and barricades are commonly used to warn people of particular dangers, such as wet floors, broken glass, wet paint, potholes, etc. as well as to prevent them from entering specific areas where such dangers may exist by serving as a physical barrier. Conventional A-frame signs often comprise two barricade frames, hinged together to form a standing device that can collapse to lie flat for easy storage and mobility. See U.S. Pat. No. 6,615,523 by Curbelo, et al. and U.S. Pat. No. 4,298,186 by Glass, among others. These types of signs typically function both as a physical barrier and as a display for warning messages, such as "KEEP OUT" or "WET FLOOR." Signs such as these are often quite small and can be stepped over or walked around. Therefore, the effectiveness of such signs depends heavily upon both the ability of people to notice them and their willingness to obey the instructions displayed on the signs.

One situation for which small A-frame signs are commonly used is during the cleaning of restrooms. In this situation, such signs are commonly used to inform people that the restroom will be temporarily closed or that the floor is wet. Although A-frame signs are typically adequate in situations such as this, they are inadequate for other types of situations. For example, if a burst pipe or other more serious problem were to cause a lengthy closure or discontinued use of the restroom, a more substantial barrier would be required. Such situations commonly require the use of fencing or much larger barricade structures, which are often not readily available on short notice or in emergency situations. Such devices are typically constructed on site from lumber, metal, plastic or other similar bulky building materials, which may not be available on-site. Even if such structures are available on site, they would require a substantial amount of storage space in which to store them.

Separate devices generally provide these two types of barriers, meaning that additional storage is required to house both types of devices. As discussed above, more substantial fencing or gates must be brought in from a distance or constructed on site from lumber or metal, which can require a significant amount of time and labor. Typical A-frame signs can be used as temporary barriers, but their effectiveness can be limited and present A-frame barriers do not have the capacity to be part of a more substantial fence, gate or similar barrier.

What is needed is a device which can function both as an A-frame sign and can be interlocked together with other such devices to form a more substantial fence or gate when needed.

SUMMARY OF THE INVENTION

It is an aspect of the present invention to provide a barricade device that can function both as an A-frame sign and can be interlocked together with other such devices to form a more substantial fence or gate when needed.

The above aspect can be achieved by a barricade device comprising: two member frames, both pivotably connected to each other by a hinge/locking mechanism wherein the member frames can be pivoted about the hinge/locking mechanism from an A-frame configuration to a fence configuration; the hinge/locking mechanism comprising a locking pin and hinge knuckles and a second pin; and wherein each member frame comprises a connecting pin and a female connecting pin receptor, wherein each female connecting receptor is configured to receive a pin receptor.

The above aspect can also be achieved by a method for using two or more barricade devices to create a fence, the method comprising: providing a first barricade device and a second barricade device, each comprising: two member frames, both pivotably connected to each other by a hinge/locking mechanism wherein the member frames can be pivoted about the hinge/locking mechanism from an A-frame configuration to a fence configuration; the hinge/locking mechanism comprising a locking pin, hinge knuckles and a second pin wherein the locking pin and the second pin are configured to be inserted through openings in the hinge knuckles, and wherein each member frame comprises at least one connecting pin and at least one female connecting pin receptor, and wherein each female connecting pin receptor is configured to receive a pin receptor; placing the first barricade into a fence configuration and locking it into the fence configuration by inserting at least one second pin of the first barricade through the hinge knuckles of the first barricade; placing the second barricade into a fence configuration and locking it into the fence configuration by inserting at least one second pin of the second barricade through the hinge knuckles of the second barricade; and connecting at least one connecting pin of the first barricade to at least one female connecting pin receptor of the second barricade.

BRIEF DESCRIPTION OF THE DRAWINGS

Further features and advantages of the present device, as well as the structure and operation of various embodiments of the present device, will become apparent and more readily appreciated from the following description of the preferred embodiments, taken in conjunction with the accompanying drawings of which.

DETAILED DESCRIPTION

Figure 1:
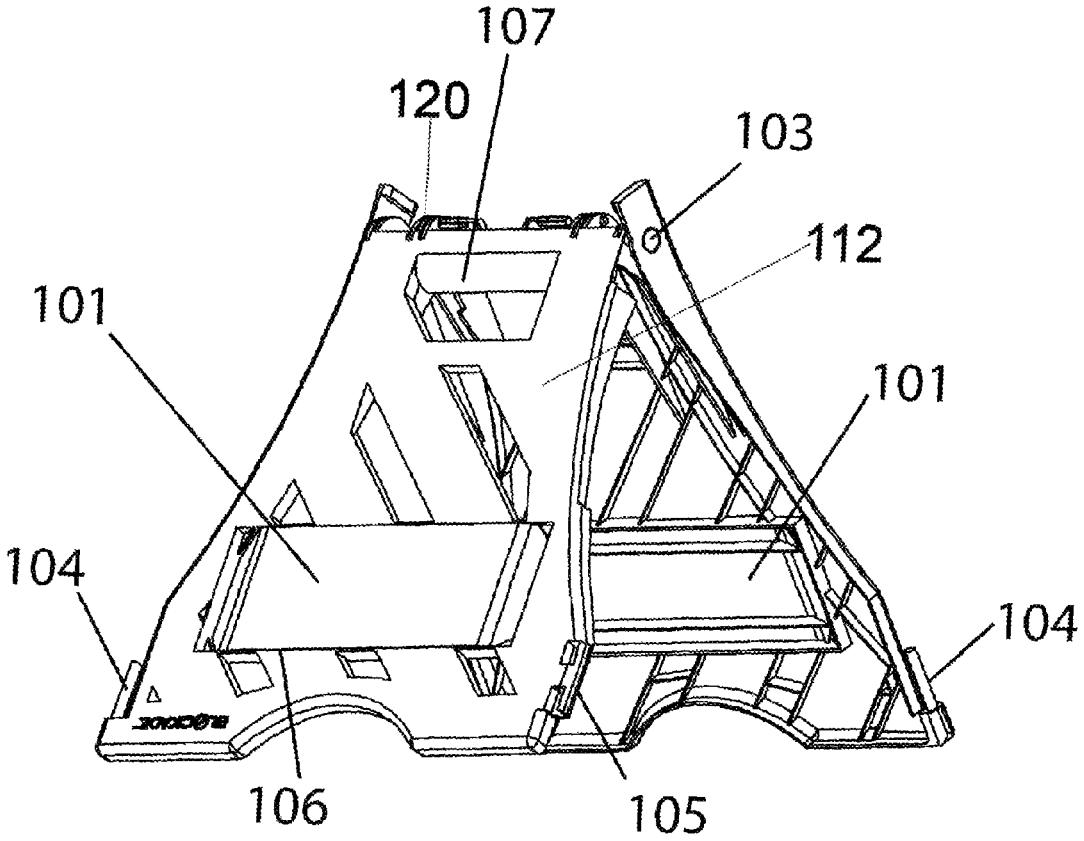
FIG. 1 is a front and side perspective view of a barricade device in an A-frame configuration, according to an embodiment.

This description of the exemplary embodiments is intended to be read in connection with the accompanying drawings, which are to be considered part of the entire written description. In the description, relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

The present barricade device can comprise two (2) member frames, hinged together at a common end by one or more hinge pins to form an A-frame configuration. This A-frame configuration can be used as a freestanding barrier or sign.

The two member frames can also be locked into a 180-degree angle by one or more locking mechanisms comprising the common ends of the member frames to form a fence configuration. In an embodiment, the two or more barricade device that have each been locked into a fence configuration can then be pivotably connected to other similarly configured barricade devices to form a barricade structure. In this configuration, the resulting barricade structure can be used as a substantial physical barrier to prevent people from entering a specific area.

FIG. 1 is a front and side perspective view of a barricade device 100 in an A-frame configuration, according to an embodiment.

The present barricade device 100 can act as a freestanding barrier to deter entry into a particular area or as a sign holding device that can warn people of a particular danger.

In an embodiment, the present barricade device 100 can comprise two (2) member frames 101 pivotably connected at a common end 120. In an embodiment, each member frame 101 can comprise a sign frame 106, a hinge stabilizer 103, a connecting pin 104, a female connecting pin receptor 105, and a handle 107. The sign frame 106 can be located near the middle of each member frame 101. The connecting pin 104 can be located at the left corner of the member frame 101 and the female connecting pin receptor 105 can be located at the right corner of the free end of the member frame 101. Note that the positions of the connecting pin 104 and the female connecting pin receptor 105 could be switched from one side to the other and the barricade device can still work successfully so long as the female connecting pin receptor 105 of one member frame 101 was always located near the connecting pin 104 of another member frame 101. The handle 107 can be located near the top of each member frame 101, according to an embodiment. When connected at an acute angle, the two member frames 101 can form an A-frame configuration with each other, which can allow the barricade device 100 to be freestanding without the need for further support by any external forces.

Figure 2:
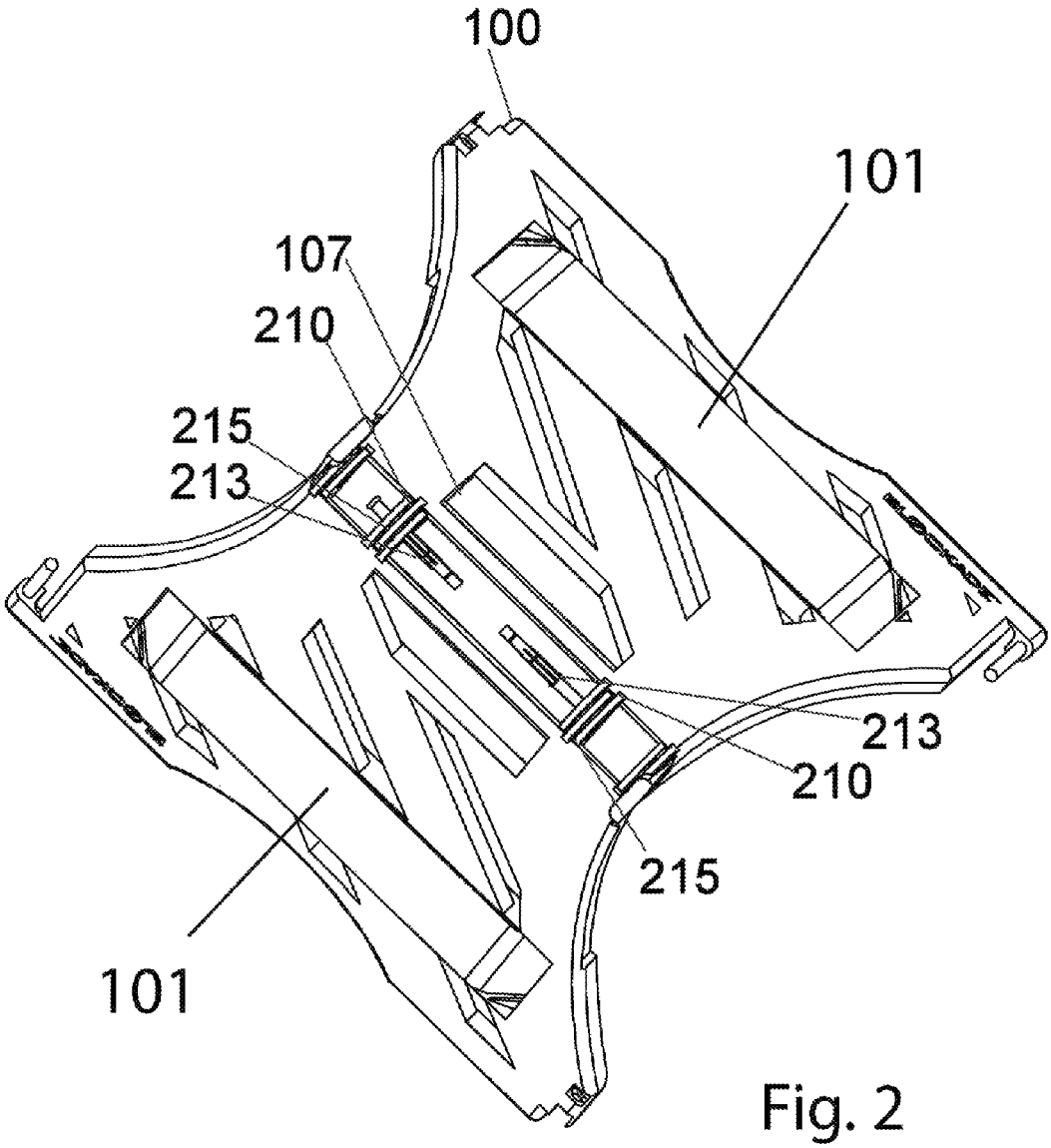
FIG. 2 is a top view of a barricade device in an A-frame configuration, according to an embodiment.

FIG. 2 is a top view of a barricade device 100 in an A-frame configuration, according to an embodiment. The barricade device 100 can comprise a handle 107 near the top of each member frame 101 allowing the barricade device 100 to be conveniently carried from one location to another location by hand.

This view allows the hinge/locking mechanism 210 to be viewed. In an embodiment, the hinge/locking mechanism 210 can comprise a locking pin 213 which can pass through two or more hinge knuckles 215 to create a pivotable joint. In the embodiment shown in FIG. 2, the barrier device 100 comprises two hinge/locking mechanisms 210.

Figure 3:
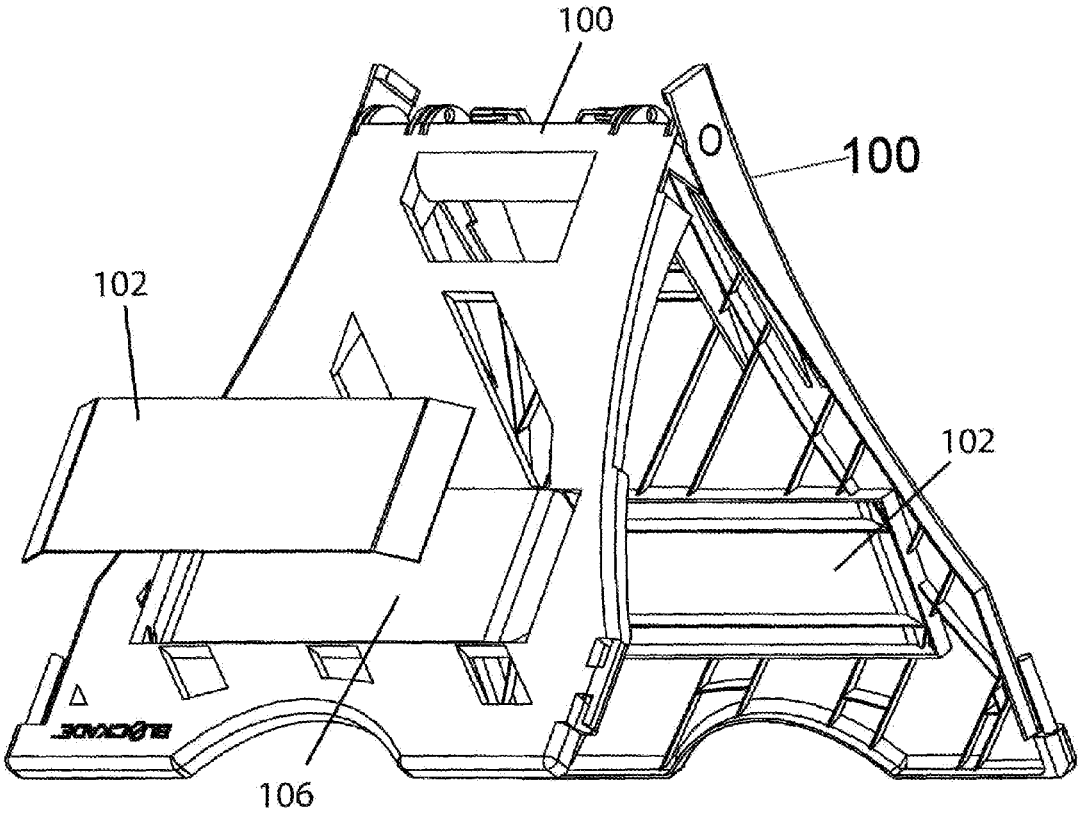
FIG. 3 is a front and side perspective view of a barricade device in an A-frame configuration, wherein a removable sign section has been disconnected from the barricade device, according to an embodiment.

FIG. 3 is a front and side perspective view of a barricade device 100 in an A-frame configuration, wherein a removable sign section 102 has been disconnected from the barricade device 100, according to an embodiment. The removable sign 102 can be installed on or be removed from the sign frame 106 of each member frame 101. The removable sign 102 can comprise a variety of designs and messages that can serve different purpose depending on the use of the barricade device 100. In an embodiment, the removable sign 102 can be reversible with different messages located on each side of the removable sign 102.

Figure 4:
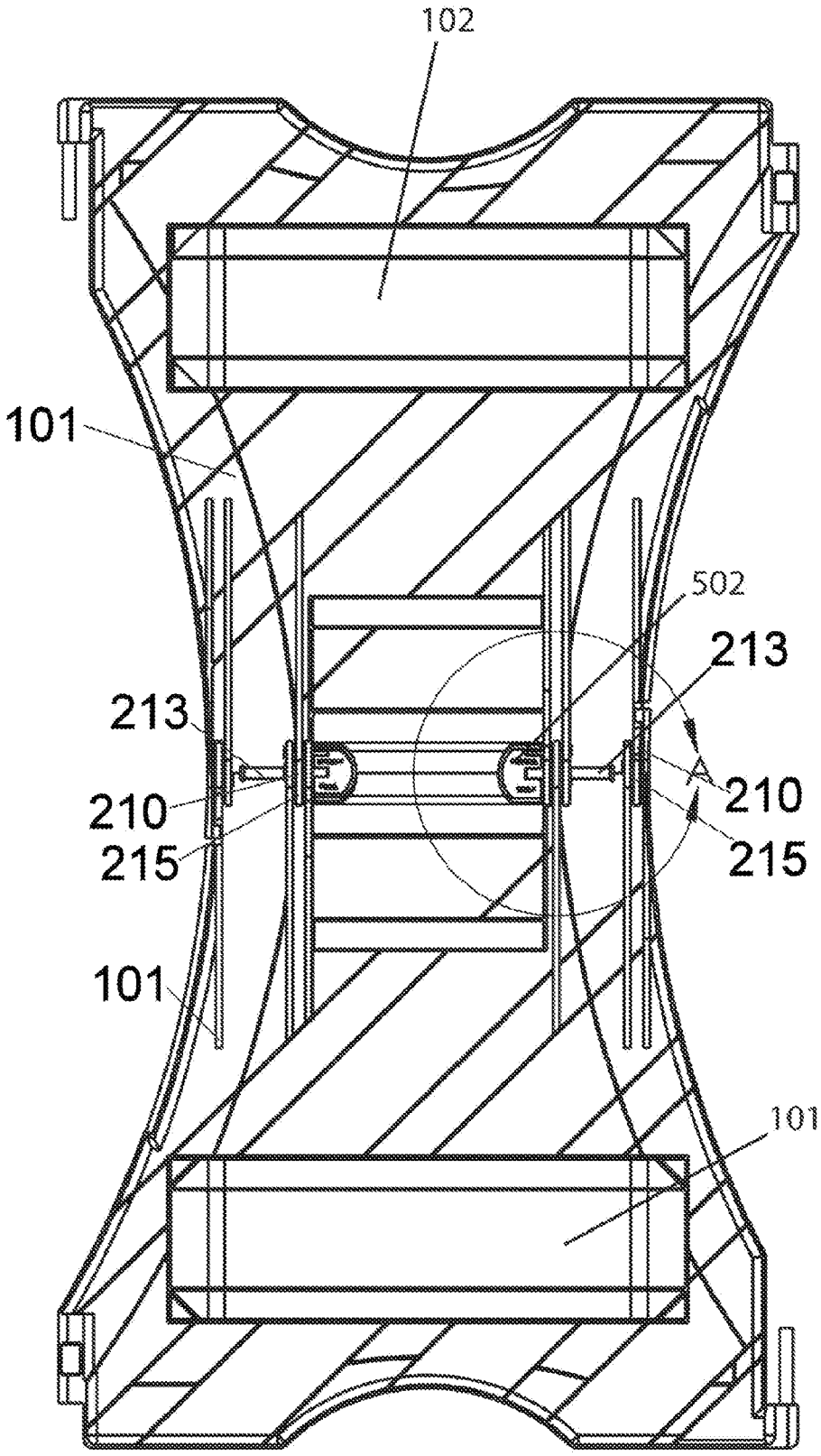
FIG. 4 is a rear view of a single barricade device in a fence configuration, according to an embodiment.

FIG. 4 is a rear view of a single barricade device 100 in a fence configuration, according to an embodiment. In an embodiment, the barricade device 100 can comprise two hinge/locking mechanisms 210 configured to lock the two member frames 101 of the barricade device 100 into a 180-degree angle with respect to each other. As mentioned above, each hinge/locking mechanism 210 can further comprise a locking pin 213 which can be configured to pass through the hinge knuckles 215. The locking pin 213 can be inserted into openings in the hinge knuckles 215 to create the hinge joint. Furthermore, the locking pin 213 can comprise a handle 502 allowing the locking pin to be moved laterally through the hinge knuckles 215.

Figure 5A:
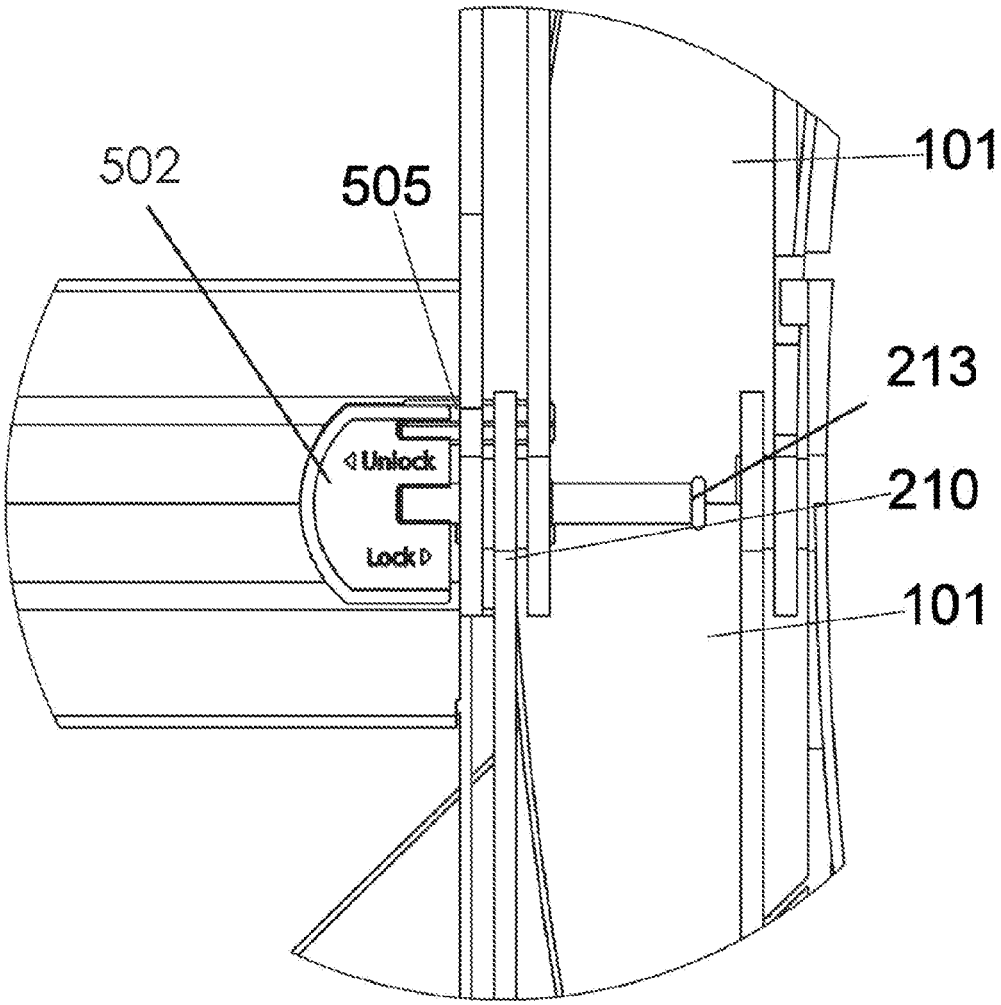
FIG. 5A is a magnified view of the hinge/locking mechanism shown in FIG. 4, according to an embodiment.

FIG. 5A is a magnified view of a hinge/locking mechanism 210 shown in FIG. 4, according to an embodiment. In an embodiment, the locking pin 213 can be configured not only to pass through the hinge knuckles 215 to create a hinge, but the locking pin 213 can also comprise a second pin 505, which can also pass through the hinge knuckles and lock the member frames 101 into the fence configuration. As discussed above, the locking pin 213 can further comprise a locking pin handle 502 to facilitate lateral movement of the locking pin 213.

Figure 5B:
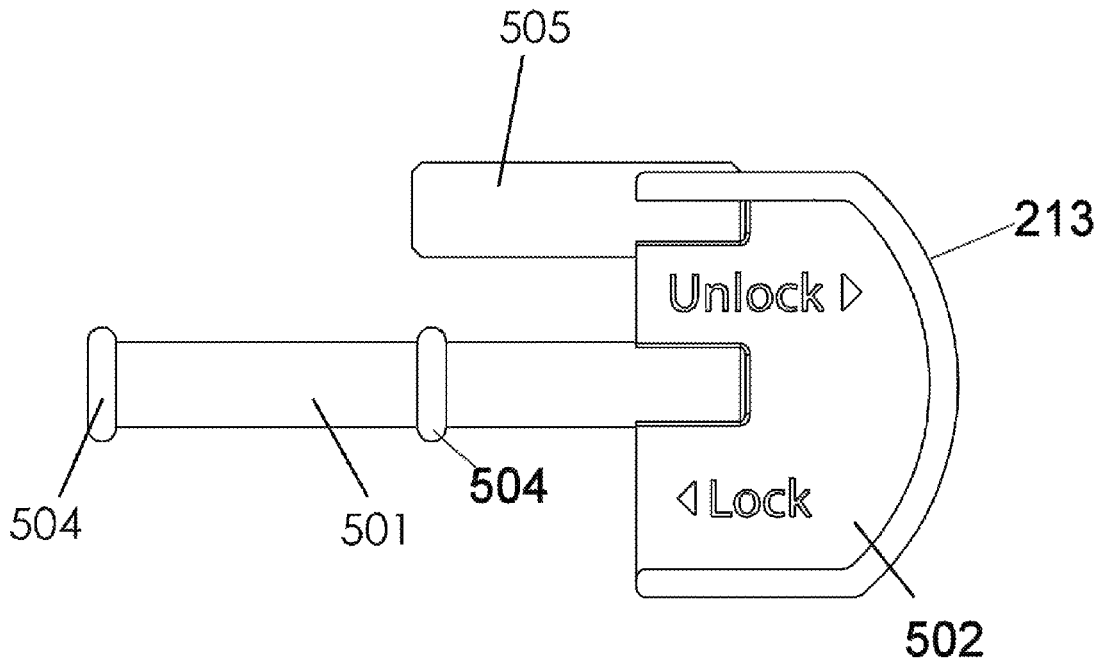
FIG. 5B is a front view of a locking pin comprising the locking mechanism shown in FIG. 5A, according to an embodiment.

FIG. 5B is a front view of a locking pin 213 comprising the hinge/locking mechanism 210 shown in FIG. 5A, according to an embodiment. In an embodiment, the locking pin 213 can further comprise two (2) locking rings 504, located on a pin section 501 of the locking pin 213. The locking rings 504 can hold the locking pin in a desired position with respect to the hinge knuckles 215 (not shown in FIG. 5B) and the pin section can provide the hinge pin about which the hinge knuckles 215 can rotate. The locking pin 213 can also comprise a second pin 505, which can pass through separate openings (not shown) in the hinge knuckles 215 locking the hinge/locking mechanism 210 in position, which is the fence configuration shown in FIG. 4. In other words, the two member frames 101 can be locked into a 180-degree angle by inserting the second pin 505 of the locking pin 213 through a second set of hinge openings (not shown) comprising the hinge knuckles 215. The member frames 101 can be unlocked by moving the second pin 505 of the locking pin 213 out of the second set of hinge openings (not shown) comprising the hinge knuckles 215 allowing the hinge knuckles 215 to rotate about the pin section 501 once again.

Figure 6:
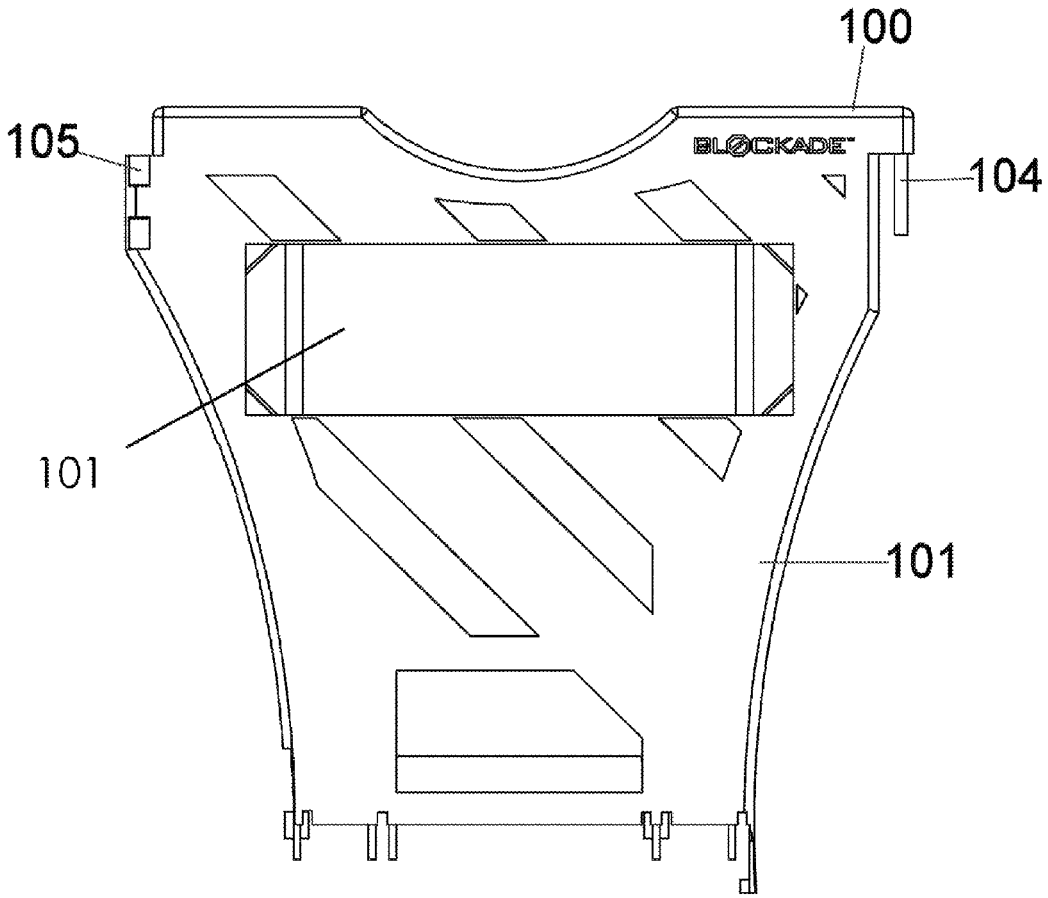
FIG. 6 is a front view of a member frame comprising a barricade device according to an embodiment.

FIG. 6 is a front view of one member frame 101 of a barricade device 100 according to an embodiment. The member frame 100 can comprise a sign frame 106, a connecting pin 104 and a female connecting pin receptor 105. The sign frame 106 can be located near the mid-section of the member frame 101. The connecting pin 104 can be located at the left corner of the member frame 101 and the female connecting pin receptor 105 can be located at the right corner of the member frame 101. The handle 107 can be located near the top of the member frame 101.

Figure 7:
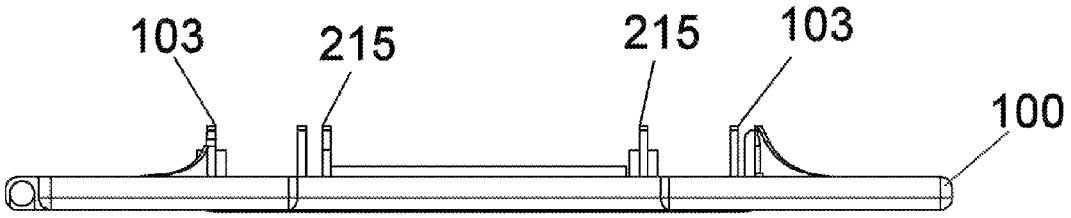
FIG. 7 is a top view of a barricade device according to an embodiment.

FIG. 7 is a top view of a barricade device 100 according to an embodiment. This view allows the hinge knuckles 215 to be viewed clearly. Hinge stabilizers 103 located at the common ends of the member frames 101 to be viewed in FIG. 7. These hinge stabilizers 103 can be configured to provide additional strength to the joint when the barricade device is in the fence configuration.

Figure 8:
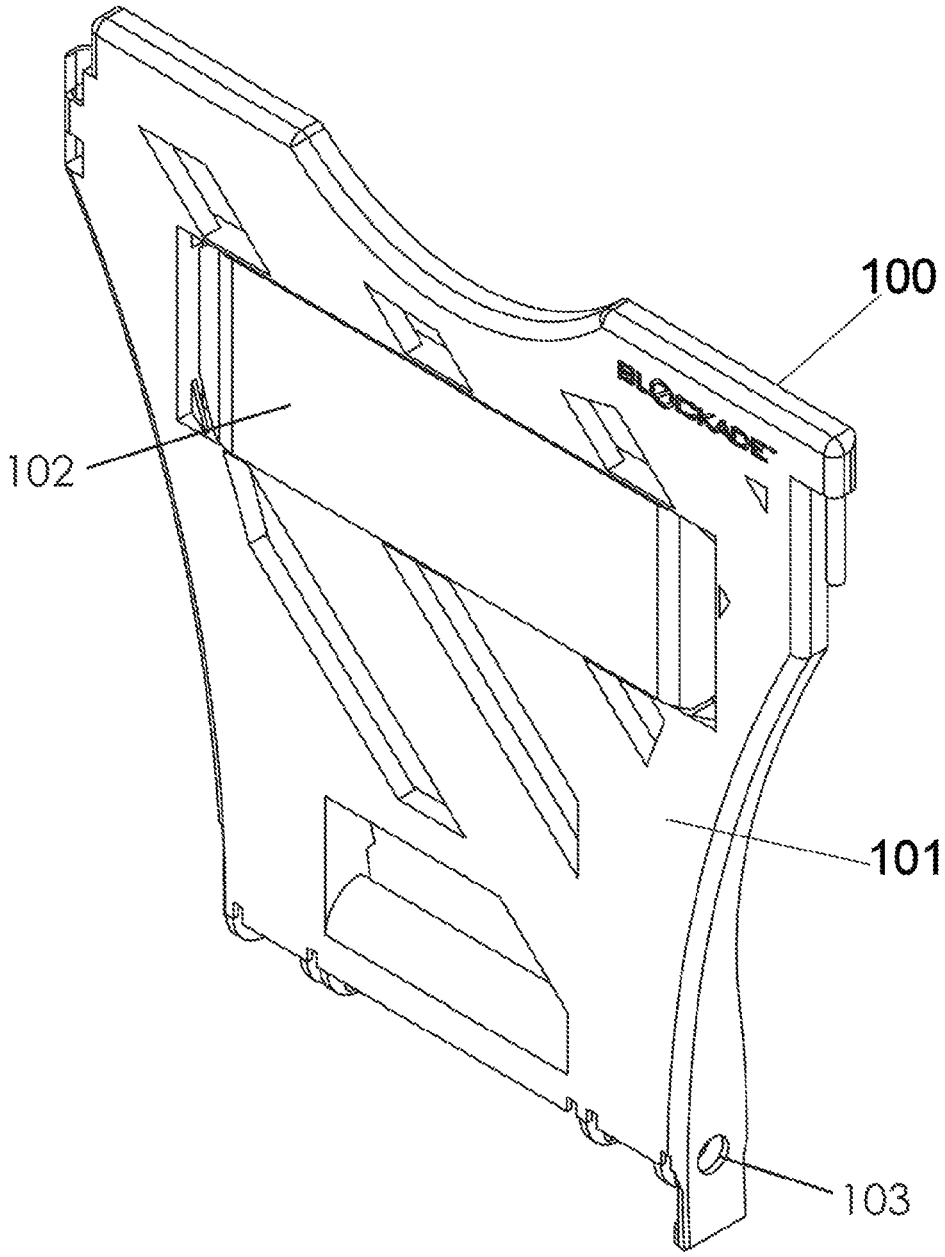
FIG. 8 is a front and side perspective view of a member frame comprising a barricade device according to an embodiment.

FIG. 8 is a front and side perspective view of a member frame 101 comprising a barricade device 100 according to an embodiment. In an embodiment, each member frame 101 can form a zero degree angle with a second member around a hinge pin 103. This configuration can allow for the easy transportation and storage of the barrier device 100.

Figure 9:
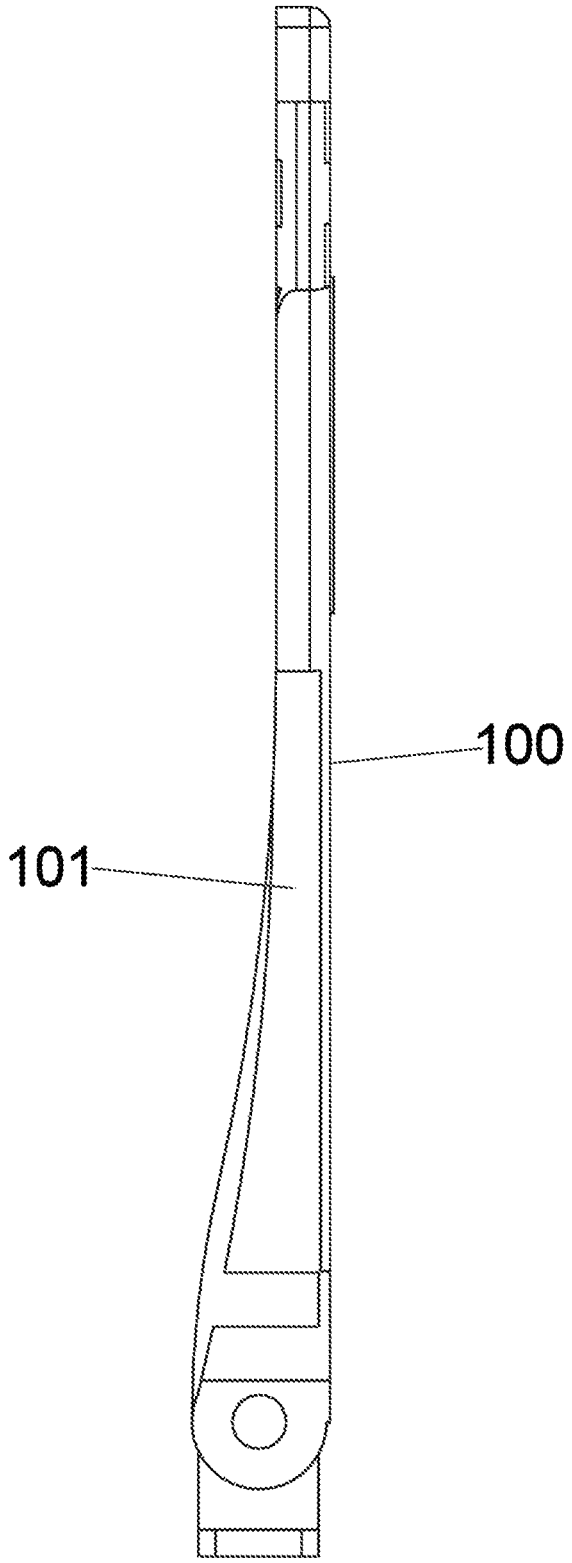
FIG. 9 is a side view of a member frame comprising a barricade device according to an embodiment.

FIG. 9 is a side view of a member frame 101 comprising a barricade device 100 according to an embodiment.

Figure 10:
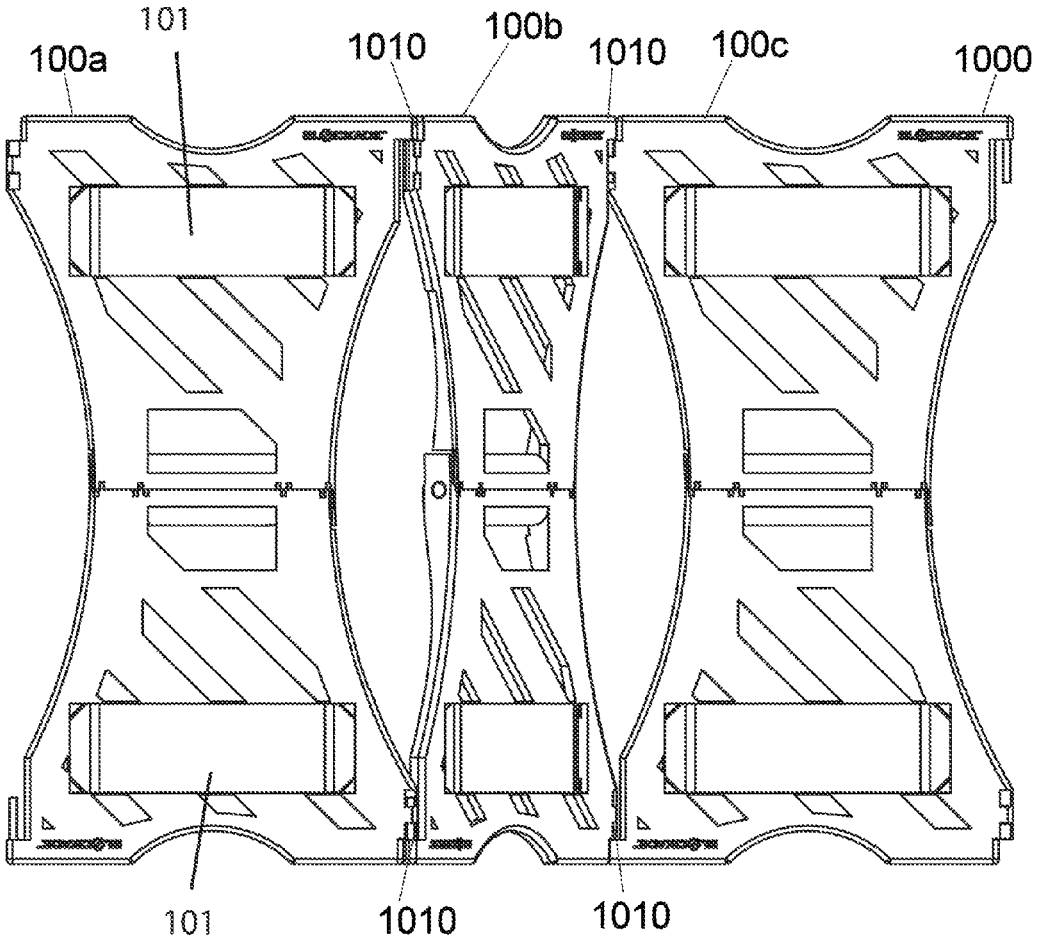
FIG. 10 is a front view of three barricade devices, each shown in a fence configuration, wherein the barricade devices are connected together to form a fence, according to an embodiment.

FIG. 10 is a front view of three barricade devices (100*a*, 100*b* and 100*c*), each shown in a fence configuration, wherein the barricade devices (100*a*, 100*b* and 100*c*), are connected together to form a fence 1000, according to an embodiment.

In FIG. 10, each of the connected barricade devices (100*a*, 100*b* and 100*c*) are shown in the fence configuration. These barricade devices (100*a*, 100*b* and 100*c*) have been connected by inserting the connecting pin 104 of each into the female connecting pin receptor 105 to create a barricade connecting joint 1010. This joint is only one possible connecting joint and the scope of the invention should not be limited to this particular connecting joint. In an embodiment, each barricade connecting joint 1010 can allow the fence 1000 to be adjusted in size and shape by allowing the angle at which each barricade connects to the others to also be adjusted. Likewise, the fence 100 can be configured to stand on its own by turning each barricade device (100*a*, 100*b* and 100*c*) slightly with respect to the others to form an angle between two barricade devices 100 about the barricade connecting joint 1010, wherein these angles can provide support to the fence 1000.

Figure 11:
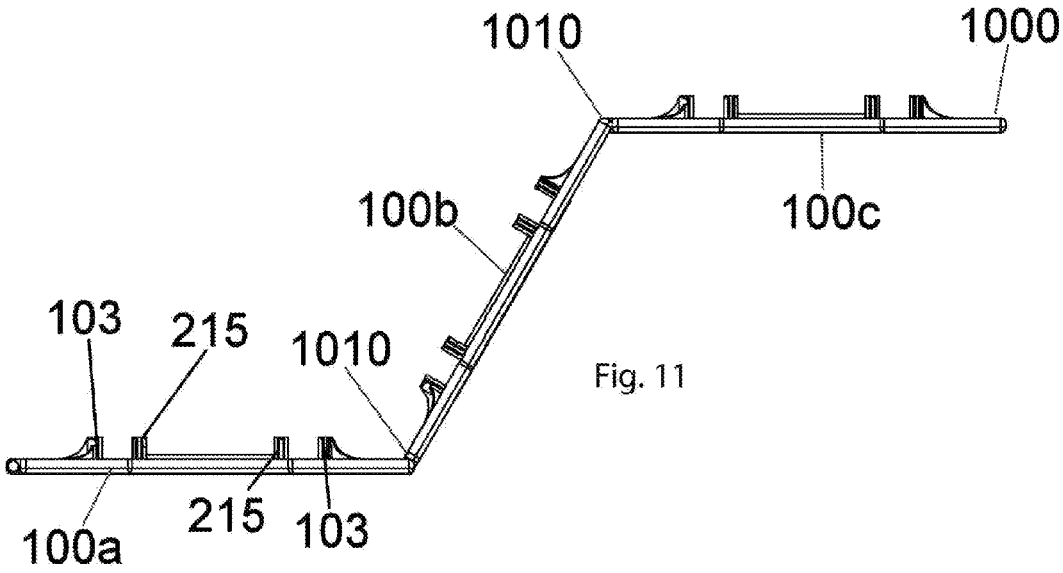
FIG. 11 is a top view of three barricade devices, each shown in a fence configuration, wherein the barricade devices are connected together to form a fence, according to an embodiment.

FIG. 11 is is a top perspective view of three barricade devices (100*a*, 100*b* and 100*c*) each shown in a fence configuration, wherein the barricade devices (100*a*, 100*b* and 100*c*) are connected together to form a fence 1000, according to an embodiment. In FIG. 11, a configuration is shown in which each barricade device (100*a*, 100*b* or 100*c*) has been turned slightly about its respective barricade connecting joint 1010 to form an angles between two or more barricade devices (100*a*, 100*b* and 100*c*). In this way, the resulting fence 1000 can be configured to stand on its own.

The present barricade device can be made from any suitable material including plastics, woods, metals, or any combination of these materials. Furthermore, the present barricade device can be made any suitable size or shape which allows it to function both in an A-frame configuration and in a fence configuration.

Although the present device has been described in terms of exemplary embodiments, it is not limited thereto. Rather, the appended claims should be construed broadly, to include other variants and embodiments of the present device, which may be made by those skilled in the art without departing from the scope and range of equivalents of the present inventive concept.

What is claimed is:

1. A barricade device comprising:

two substantially planar member frames, each member frame comprising:

an upper end and an opposing lower end, with opposing first and second sides connecting the upper and lower ends, the upper end of each member frame including at least one hinge knuckle configured to engage a complementary hinge knuckle on the other member frame, the lower end of each member frame including a connecting pin on the first side thereof and a female connecting pin receptor on the second side thereof, both substantially parallel to the member frame, wherein each female connecting pin receptor is configured to receive a connecting pin of a second barricade device to create a barricade connecting joint;

both frames pivotably connected to each other about a first axis defined along the upper end of each member frame and extending through first openings in the hinge knuckles by a hinge/locking mechanism connected to at least one of the member frames adjacent the upper end thereof;

the hinge/locking mechanism comprising:

a locking pin passing through the first openings in the hinge knuckles of both member frames, and a second pin, parallel to and connected with the locking pin, wherein the second pin is configured for insertion into second openings in the hinge knuckles, offset from the first openings;

wherein the member frames are pivotable between:

an A-frame configuration, wherein the member frames form an acute angle about the first axis and the second pin is not inserted into the second openings, and a fence configuration, wherein the member frames form a 180 degree angle about the first axis, the second pin is inserted into the second openings thereby locking the member frames into the fence configuration, and the connector pins and female connecting pin receptors are aligned so as to pivotably engage with the female connecting pin receptors and connector pins of a second barricade device, respectively, about a second axis perpendicular to the first axis.

2. The barricade device as recited in claim 1 wherein the locking pin comprises a pin section, and locking rings.

3. The barricade device described claim 2 wherein the locking pin further comprises a locking pin handle.

4. The barricade device described in claim 1 wherein one or more member frames comprises a sign frame configured to connect to a sign.

5. The barricade device described in claim 1 wherein one or more member frames comprises a handle.

6. The barricade device described in claim 1 wherein one or more member frames comprises a hinge stabilizer.

7. A method for using two or more barricade devices to create a fence, the method comprising:

providing a first barricade device and a second barricade device, each comprising a barricade device according to claim 1;

placing the first barricade into the fence configuration and locking it into the fence configuration by inserting the second pin of the first barricade through the second openings of the hinge knuckles of the first barricade;

placing the second barricade into a fence configuration and locking it into the fence configuration by inserting the second pin of the second barricade through the second openings of the hinge knuckles of the second barricade; and connecting at least one connecting pin of the first barricade to at least one female connecting pin receptor of the second barricade along the second axis to create a barricade connecting joint.

8. The method described in claim 7 wherein at least one connecting pin of the second barricade is connected to at least one female connecting pin receptor of the first barricade to create a second barricade connecting joint.

* * * * *